US012668952B2

(12) United States Patent
Lehocky

(10) Patent No.: US 12,668,952 B2
(45) Date of Patent: Jun. 30, 2026

(54) AUDIO-VISUAL ASSIST FOR EFFICIENT PILING OR STACKING OF MATERIALS

(71) Applicant: Caterpillar Inc., Peoria, IL (US)

(72) Inventor: Craig Allan Lehocky, Pittsburgh, PA (US)

(73) Assignee: Caterpillar Inc., Peoria, IL (US)

( * ) Notice: Subject to any disclaimer, the term of this patent is extended or adjusted under 35 U.S.C. 154(b) by 254 days.

(21) Appl. No.: 18/395,187

(22) Filed: Dec. 22, 2023

(65) Prior Publication Data

US 2025/0207366 A1 Jun. 26, 2025

(51) Int. Cl.
*E02F 9/26* (2006.01)

(52) U.S. Cl.
CPC ..... *E02F 9/261* (2013.01); *E02F 9/264* (2013.01)

(58) Field of Classification Search
None
See application file for complete search history.

(56) References Cited

U.S. PATENT DOCUMENTS 6,634,109 B1 * 10/2003 Dale, Jr. ..... G01B 11/2755 33/203.18
8,538,724 B2 * 9/2013 Corghi ..... G01B 11/2755 356/139.1
10,407,878 B2 9/2019 Wei
10,640,952 B2 5/2020 Redenbo et al.
11,118,453 B2 9/2021 Wei
11,236,492 B1 2/2022 Ready-Campbell
2019/0352880 A1 * 11/2019 Wei ..... E02F 3/841
2020/0293059 A1 * 9/2020 Wang ..... G06V 20/56
2020/0394813 A1 * 12/2020 Theverapperuma ..... G05D 1/0257
2021/0124359 A1 * 4/2021 Wei ..... E02F 9/2054
2021/0277627 A1 * 9/2021 Lucas ..... E02F 3/434
2024/0052605 A1 * 2/2024 Kean ..... E02F 3/434

* cited by examiner

*Primary Examiner* — Hunter B Lonsberry
*Assistant Examiner* — Robert L Pinkerton

(57) ABSTRACT

A method and system for controlling a machine is provided herein, including: receiving measurements indicative of one or more geometric characteristics of a material pile; determining a difference between the one or more geometric characteristics of the material pile and one or more target geometric characteristics of the material pile, the difference being indicative of material to be moved by the machine; determining a target position associated with a material movement operation of the machine, wherein the target position is based on the difference, wherein the target position corresponds to a single material movement operation, and wherein the target position is updated for each subsequent material movement operation of a plurality of material movement operations that are calculated to collectively result in the one or more target geometric characteristics of the material pile; and providing an indication of the target position to an operator of the machine.

20 Claims, 9 Drawing Sheets

AUDIO-VISUAL ASSIST FOR EFFICIENT PILING OR STACKING OF MATERIALS

TECHNICAL FIELD

The present disclosure relates generally to the field of movement of materials by heavy machinery, specifically to devices and methods to assist operators of heavy machinery moving materials.

BACKGROUND

In applications involving bulk dozing, such as topsoil removal, the operator of the bulldozer is tasked with the extraction of pre-existing materials from the terrain and determining their optimal placement based on their intended purpose. For instance, some materials may need to be developed into a stable mound that can subsequently be removed by hauling or carrying machinery. Alternatively, other material may require arrangement into a series of small heaps or piles to create a cohesive loaf-like structure or stack, a technique commonly referred to as back-stacking. An operator must keep several factors in mind while forming the stacks or mounds. For example, the structures must be built to an appropriate height, not too short nor too high, and must be designed with correct slopes so as to facilitate traversal and drainage. To do this, the operator must accurately gauge the total quantity of material extracted during the bulk dozing operation. This proves to be a formidable task for manual operators, as it entails estimating the volume of material moved by estimating the volumetric differences between the initial terrain, the current (as-is) terrain, and the final design terrain. Such an estimation is subject to substantial variation depending on the operator's experience.

When operating a dozer, the operator will receive visual and tactile feedback from the machine and the environment, assisting the operator in fulfilling material movement operations. However, remote operation of heavy machinery is increasingly common. Remote operators of heavy machine report difficulties in understanding when and where to start or stop operations with the machines due to a lack of visual and tactile feedback.

SUMMARY

In a first aspect, a method of controlling a machine is provided herein. In some embodiments, the method includes: receiving, by one or more processors and from one or more sensors, measurements indicative of one or more geometric characteristics of a material pile; determining, by the one or more processors, a difference between the one or more geometric characteristics of the material pile and one or more target geometric characteristics of the material pile, the difference being indicative of material to be moved by the machine; determining, by the one or more processors, a target position associated with a material movement operation of the machine, wherein the target position is based on the difference, wherein the target position corresponds to a single material movement operation, and wherein the target position is updated for each subsequent material movement operation of a plurality of material movement operations that are calculated to collectively result in the one or more target geometric characteristics of the material pile; and providing, by the one or more processors, an indication of the target position to an operator of the machine.

In some embodiments, the indication provided to the operator of the machine is a visual indication, an audible indication, a haptic indication, or a combination thereof. In some embodiments, the target position comprises at least one of an initial contact position for a tool associated with the machine, an end contact position for the tool, a position for the machine associated with the beginning of a current material movement operation, a position of the machine associated with the end of the current material movement operation, a position for the machine associated with the beginning of a previous material movement operation, a position of the machine associated with the end of the previous material movement operation, a target leading edge of the material pile, a target trailing edge of the material pile, a position of the machine, or a slope of the machine.

In some embodiments, the indication to the operator of the machine comprises: displaying, via a display unit, to the operator a visual indicator of the target position. In some embodiments, the visual indicator comprises a plane overlaying a representation of at least a portion of the material pile. In some embodiments, the visual indicator comprises one or more planes indicating boundaries of the target position. In some embodiments, the one or more planes indicating boundaries include an end plane that corresponds to an end point for depositing an amount of material on a current material movement operation.

In some embodiments, the method also includes changing one or more visual features of the visual indicator based on a position of the machine, the one or more geometric characteristics of the material pile, or the one or more target geometric characteristics of the material pile.

In some embodiments, a frequency of the audible indication or a frequency of the haptic indication changes based on a position of the machine with respect to the target position, the one or more geometric characteristics of the material pile, or the one or more target geometric characteristics of the material pile. In some embodiments, determining the difference is based on one or more of: portions of a surface of the material pile that are lower than a target surface of the material pile, portions of the surface of the material pile that are higher than the target surface of the material pile, a slope of the material pile, a leading edge of the material pile, a trailing edge of the material pile, a height of the material pile, a length of the material pile, or volume of the material pile.

In some embodiments, the visual indicator further indicates information of at least one of the one or more target geometric characteristics of the material pile or the difference.

Another aspect disclosed herein relates to a control circuit. In some embodiments, the control circuit includes one or more processors and memory structured to store instructions that, when executed by the one or more processors, cause the control circuit to: receive, by one or more processors and from one or more sensors, measurements indicative of one or more geometric characteristics of a material pile; determine, by the one or more processors, a difference between the one or more geometric characteristics of the material pile and one or more target geometric characteristics of the material pile, the difference being indicative of material to be moved by the machine; determine, by the one or more processors, a target position associated with a material movement operation of the machine, wherein the target position is based on the difference, wherein the target position corresponds to a single material movement operation, and wherein the target position is updated for each subsequent material movement operation of a plurality of material movement operations that are calculated to collectively result in the one or more target geometric characteristics of the material pile; and provide, by the one or more processors, an indication of the target position to an operator of the machine.

The difference can be communicated to the operator by an indication. In some embodiments, the indication provided to the operator of the machine is a visual indication, an audible indication, a haptic indication, or a combination thereof. In some embodiments, the target position comprises at least one of an initial contact position for a tool associated with the machine, an end contact position for the tool, a position for the machine associated with the beginning of a current material movement operation, a position of the machine associated with the end of the current material movement operation, a position for the machine associated with the beginning of a previous material movement operation, a position of the machine associated with the end of the previous material movement operation, a target leading edge of the material pile, a target trailing edge of the material pile, a position of the machine, or a slope of the machine.

In some embodiments, providing an indication to an operator of the machine comprises: displaying, via a display unit, to the operator a visual indicator of the target position. In some embodiments, the visual indicator comprises a plane overlaying a representation of at least a portion of the material pile. In some embodiments, the visual indicator comprises one or more planes indicating boundaries of the target position. In some embodiments, the control circuit also configured to change one or more visual features of the visual indicator according to a position of the machine, the one or more geometric characteristics of the material pile, or the one or more target geometric characteristics of the material pile.

In some embodiments, the one or more planes indicating boundaries include an end plane that corresponds to an end point for depositing an amount of material on a current material movement operation. In some embodiments, the control circuit is configured to adjust a frequency of an audible indication or a frequency of a haptic indication according to a position of the machine with respect to the target position, the one or more geometric characteristics of the material pile, or the one or more target geometric characteristics of the material pile. In some embodiments, the control circuit is configured to determine the difference according to one or more of: portions of a surface of the material pile that are lower than a target surface of the material pile, portions of the surface of the material pile that are higher than the target surface of the material pile, a slope of the material pile, a leading edge of the material pile, a trailing edge of the material pile, a height of the material pile, a length of the material pile, or a volume of the material pile.

In some embodiments, the one or more sensors are a camera, a stereocamera, a SONAR, a LIDAR, a 4D radar, or a combination thereof.

Another aspect disclose herein relates to a machine. In some embodiments, the machine includes: a tool for engaging with a material of a material pile; a sensor configured to measure one or more geometric characteristics of the material pile; and a control circuit comprising one or more processors and memory structured to store instructions that, when executed by the one or more processors, cause the control circuit to: receive, by one or more processors and from one or more sensors, measurements indicative of one or more geometric characteristics of a material pile; determine, by the one or more processors, a difference between the one or more geometric characteristics of the material pile and one or more target geometric characteristics of the material pile, the difference being indicative of material to be moved by the machine; determine, by the one or more processors, a target position associated with a material movement operation of the machine, wherein the target position is based on the difference, wherein the target position corresponds to a single material movement operation, and wherein the target position is updated for each subsequent material movement operation of a plurality of material movement operations that are calculated to collectively result in the one or more target geometric characteristics of the material pile; and provide, by the one or more processors, an indication of the target position to an operator of the machine.

DETAILED DESCRIPTION

Before turning to the figures, which illustrate certain embodiments in detail, it should be understood that the present disclosure is not limited to the details or methodology set forth in the description or illustrated in the figures. It should also be understood that the terminology used herein is for the purpose of description only and should not be regarded as limiting.

Machine

Figure 1:
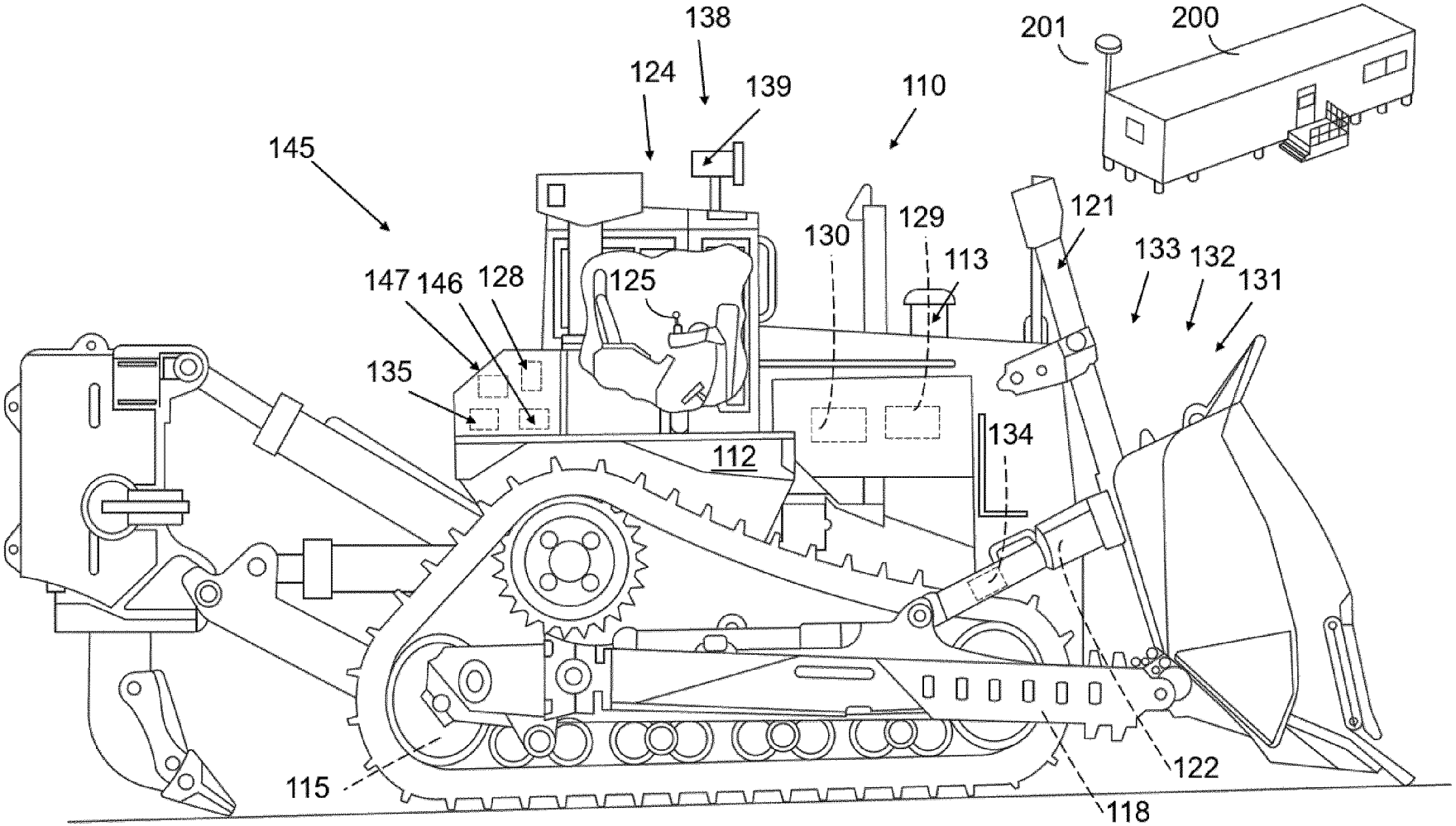
FIG. 1 is a diagram of a machine, according to an embodiment.

FIG. 1 depicts a diagrammatic illustration of a machine 110, such as a dozer, with a work implement or tool, such as a blade 116, configured to push material. The machine 110 includes a frame 112 and a power source, such as an engine 113. The machine 110 features a mobility system such as a track 115 or wheels (not shown). The track 115 may be driven by a drive sprocket 114 on opposite sides of machine 110 that when powered by the engine 113, cause the track to advance and thereby propel the machine. A movement system employing a track 115 such as the one illustrated in FIG. 1 may be advantageous in maneuvering the machine in uneven terrain, such as is common at work sites. The engine 113 and a transmission (not shown) are operatively connected to the drive sprockets 114, which transmit power to advance the tracks 115. Although a dozer is shown in FIG. 1, it should be understood that this is for illustrative purposes only. The systems and methods disclosed herein may be used with any machine propulsion and drivetrain mechanisms applicable in the art for causing movement of the machine including hydrostatic, electric, or mechanical drives. The systems and method disclosed herein should not be considered to be limited to dozers only.

The machine's blade or other tool 116 is pivotably connected to the frame 112 by arms 118 on each side of machine 110. A first set of hydraulic cylinders 121 coupled to frame 112 supports blade 116 in the vertical direction and allows blade 116 to move up or down as needed to engage a material. A second set of hydraulic cylinders 122 on each side of machine 110 allow the pitch angle of blade tip to change relative to a centerline of the machine.

The machine 110 may include a cab 124 to provide space for an operator to physically occupy while the operator provides input to control the machine. The cab 124 may include one or more operator input devices such as joysticks, pedals, buttons, levers, and/or wheels 125 through which the operator may issue commands to control the propulsion and steering systems of the machine, as well as to control the height and pitch of the tool/blade 116. Some or all of the controls may be configured to provide tactile feedback to an operator of the machine 110. Controls 125 may vibrate, pulse, or change resistance to movement in response to various conditions of the machine 110 or an operation.

The machine 110 may be equipped with a plurality of machine sensors 138 that provide data indicative (directly or indirectly) of various operating parameters of the machine and/or the operating environment in which the machine is operating. The term "sensor" is meant to be used in its broadest sense to include one or more sensors and related components that may be associated with the machine 110 and that may cooperate to sense various functions, operations, and operating characteristics of the machine and/or aspects of the environment in which the machine is operating. The machine may include sensors 138 to detect, for example, a three-dimensional map of the surrounding terrain of the work site. The machine may include sensors 138 to detect, for example, a visual representation of the surrounding terrain of the work site and/or to detect material piles. The machine may include sensors 138 to determine or identify a type of material at the work site or in a material pile. The sensors 138 may include a LIDAR, a camera, a stereocamera, or a 4D camera, as non-limiting examples.

Figure 2:
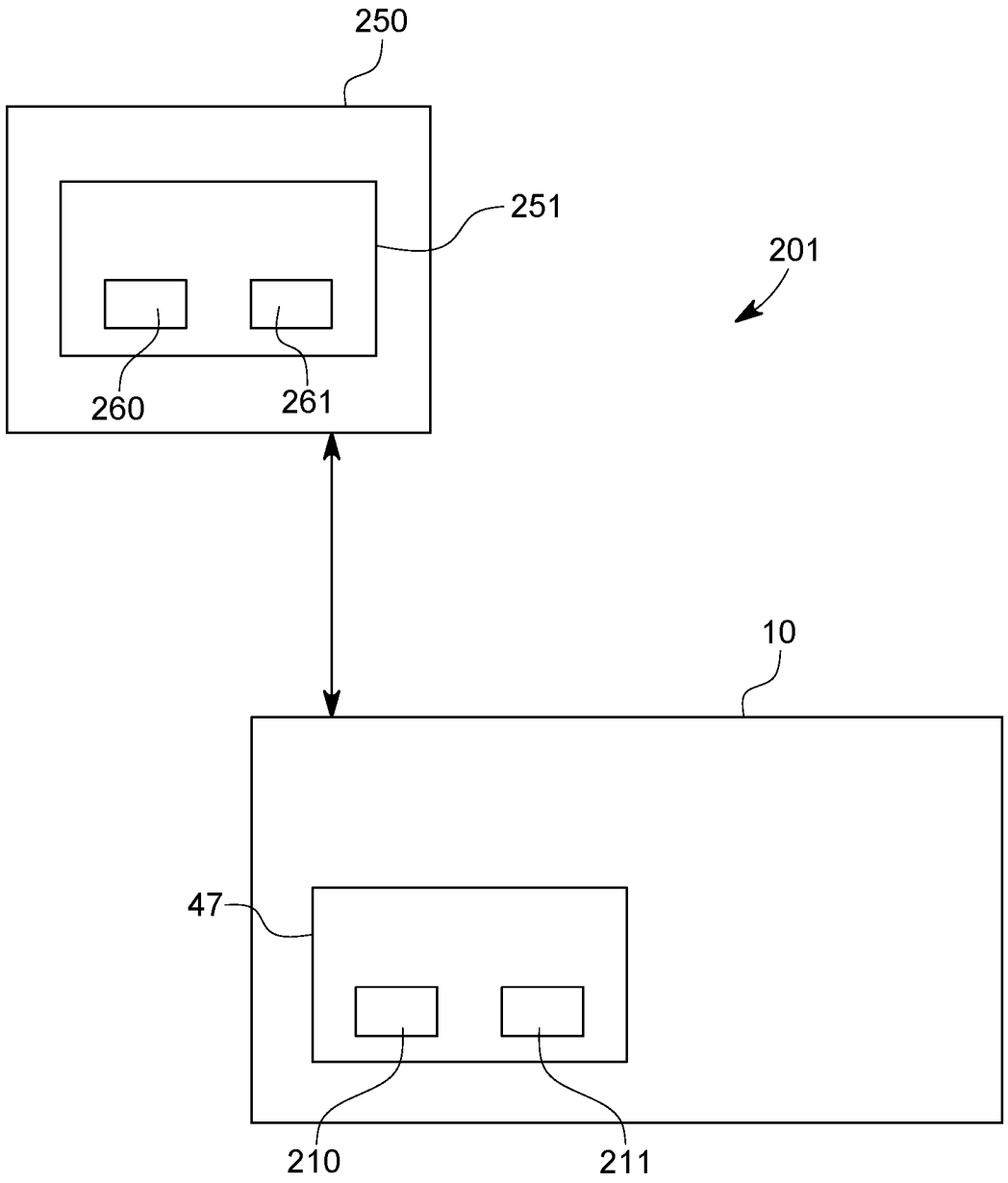
FIG. 2 is a schematic illustration of a portion of a remote control unit, according to an embodiment.

The machine 110 may be controlled by a control system 145 as shown generally as an arrow in FIG. 2 indicating association with the machine 110. The control system 145 (and thereby the machine) may be autonomous, semi-autonomous, or manually controlled. The control system 145 includes an electronic control module or controller 146 and a plurality of sensors (not shown). The controller 146 includes one or more processors and memory for storing computer instructions. The control system 145 may receive input signals from an operator operating the machine 110 from within cab 124 or remotely. The control system 145 may be configured to receive commands for the machine through a wireless communications system 201. The controller 146 may control the operation of various aspects of the machine 110 including the propulsion and steering system, and the drivetrain and hydraulic systems.

The controller 146 may be an electronic controller that operates in a logical fashion to perform operations, execute code configured to provide control algorithms, store and retrieve data, interface with networks, and other desired operations. The controller 146 may include or be configured to access memory, primary storage devices, secondary storage devices, processors, networks, and any other components for executing code. The memory and secondary storage devices may be in the form of read-only memory (ROM) or random access memory (RAM) or integrated circuitry that is accessible by the controller. Various other circuits may be associated with the controller 146 such as power supply circuitry, signal conditioning circuitry, control circuitry, driver circuitry, and other types of circuitry.

The controller 146 may be a single controller or may include more than one controller disposed to control various functions and/or features of the machine 110. The term "controller" is meant to be used in its broadest sense to include one or more controllers and/or microprocessors that may be associated with the machine 110 and that may cooperate in controlling various functions and operations of the machine. The functionality of the controller 146 may be implemented in hardware and/or software without regard to the functionality. The controller 146 may rely on one or more data maps relating to the operating conditions and the operating environment of the machine 110 and the work site 100 that may be stored in the memory associated with the controller. Each of these data maps may include a collection of data in the form of tables, graphs, and/or equations.

In some embodiments, the control system 145 and the controller 146 are located on the machine 110. In some embodiments, portions of the control system 145 are in a location remote to the machine, such as at a command center 200 or at a remote control unit. In such embodiments, the controller 146 may be configured to receive signals wirelessly from the control system 145 to operate the machine. The functionality of the control system 145 may be distributed so that certain functions are performed at machine 110 and other functions are performed remotely. In such case, the control system 145 may include a communications system such as wireless communications system 201 for transmitting signals between the machine 110 and the control system 145 or portions of the control system that are located remote from the machine. In an embodiment, the remote control unit 250 positioned remote from the machine 110 may provide some or all of the specific commands that are then transmitted by the wireless communications system 201 to systems of the machine.

The machine 110 may be configured to be operated autonomously, semi-autonomously, or manually. When operating semi-autonomously or manually, the machine 110 may be operated by remote control and/or by an operator physically located within the cab 124. When operating the machine 110 via a remote control system, a portion of the control system 145 may be located at the remote control unit 250. Accordingly, machine 110 may include a machine controller 147 and remote control unit 250 may include a remote unit controller 251 (FIG. 2). The machine controller 147 and the remote unit controller 251 may be components of the controller 146.

Figure 3:
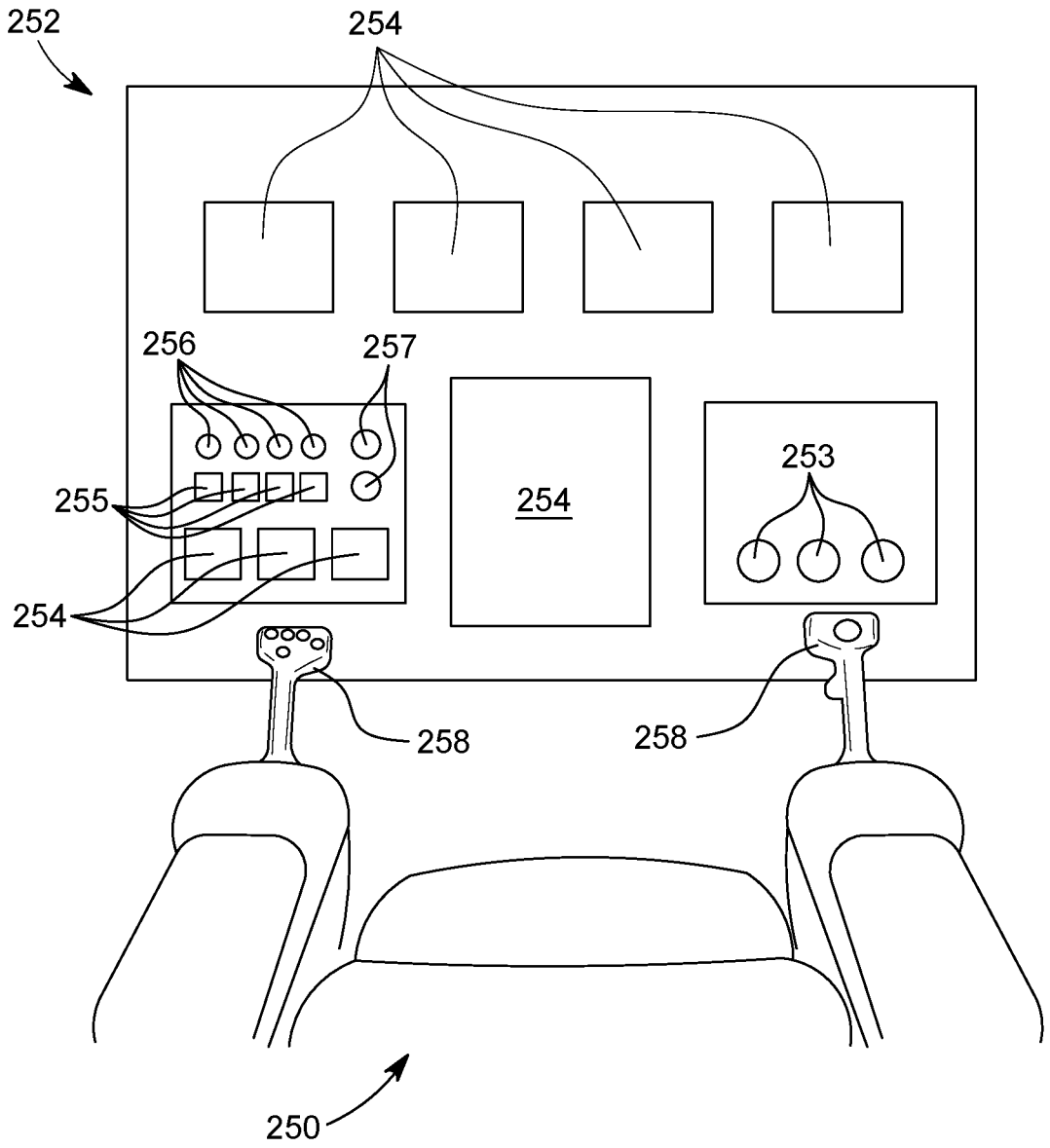
FIG. 3 is a schematic illustration of a control panel for an operator, according to an embodiment.

Referring now to FIG. 3, in one example, the remote control unit 250 may be configured with an instrument array 252 and controls similar to that of the machine 110 with a plurality of gauges 253, image display devices 254, and operator input devices such as buttons 255, knobs 256, dials 257, levers such as joysticks 258, pedals (not shown), and other controls. If desired, the remote control unit 250 may be configured in a manner similar to the actual cab 124 of the machine 110. Signals from the various sensors on the machine 110 may be transmitted directly or indirectly to the remote control unit 250 and displayed on the instrument array. The display devices 254 may be configured to display live images of the environment surrounding the machine. The images displayed by the display devices 254 may be augmented to provide additional data to the operator. As a non-limiting example, the display devices 254 may be configured to display a live image of the environment surrounding the machine augmented with data, measurements, position indicators, or other data, as further discussed below.

When operating machine 110 by remote control, the machine 110 and the remote control unit 250 may communicate via the wireless communications system 201. Each of the machine 110 and the remote control unit 250 may include wireless communication devices to permit wireless transmission of a plurality of data signals between the machine and the remote control unit as well as permit communication with other systems remote from the machine and the remote control unit.

As depicted in FIG. 2, the machine 110 may include machine transmitter 210 and a machine receiver 211. The remote control unit 250 may include a remote control transmitter 260 and a remote control receiver 261. The transmitters and receivers may be a portion of the respective machine controller 147 and the remote unit controller 251, if desired. In operation, signals transmitted by the remote control unit 250 may be generated by the remote unit controller 251 and then transmitted by the remote control transmitter 260 to the machine receiver 211 and then processed by machine controller 147. Signals transmitted from the machine 110 to the remote control unit 250 may be generated by the machine controller 147 and then transmitted by the machine transmitter 210 to the remote control receiver 261 and then processed by remote unit controller 251.

The control system 145 may include an additional system such as a change in terrain detection system 131 shown generally by an arrow in FIG. 2 indicating association with the machine 110. One type of change in terrain detection system 31 that may be used to sense a crest at the work site 100 may be an implement load monitoring system 32 shown generally by an arrow in FIG. 2. The implement load monitoring system 132 may include any of a variety of different types of implement load sensors depicted generally by an arrow in FIG. 2 as an implement load sensor system 133 to measure the load on the ground engaging work implement or blade 116. For example, as blade 116 of machine 110 moves material over a crest, the load on the blade will be reduced. Accordingly, the implement load sensor system 133 may be utilized to measure or monitor the load on the blade 116 and a decrease in load may be registered by the controller 146 as a change in terrain due to the machine 110 being adjacent the crest. In other instances, an increase in load may indicate an incline or the machine 110 encountering a pile of material. In other words, the controller 146 may determine a change in terrain or material based at least in part upon a change in the load on blade 116.

In one embodiment, the implement load sensor system 133 may embody one or more pressure sensors 134 for use with one or more hydraulic cylinders, such as second hydraulic cylinders 122, associated with blade 116. Signals from the pressure sensor 134 indicative of the pressure within the second hydraulic cylinders 122 may be monitored by controller 146. Upon receipt of a signal indicating a substantial reduction in pressure within the second hydraulic cylinders 122, the controller 146 may determine that the load on blade 116 has been substantially reduced due to the material having been pushed over a crest. Other manners of determining a reduction in cylinder pressure associated with a reduction in the load on blade 116 are contemplated, including other manners of measuring the pressure within second hydraulic cylinders 122 and measuring the pressure within other cylinders associated with the blade. An increase in pressure indicative of an increase in load may be determined in a similar manner.

The implement load sensor system 133 may be used in part to determine when a material movement operation should start or end and to provide a signal to the control system 145 to provide an indication regarding the operation to the operator. For example, in a backstacking operation, the load sensor system 133 may detect a decrease in the load as the machine nears a crest and the material being pushed begins to spill over the crest, and may provide a signal to the control system 145 to provide an indication to the operator to begin raising the blade 116 and to reverse the movement of the machine 100. As another example, in a pile building operation, the load sensor system 133 may detect an increase in the load as the machine presses the material into the pile, and may provide a signal to the control system 145 to provide an indication to the operator to raise the blade 116 and to reverse the movement of the machine 100. As provided herein, the indication provided by the control system 145 may be visual, auditory, tactile, or a combination of two or more thereof.

Pile Building and Backstacking

Pile building and backstacking are operations that may be carried out by a machine 110 to move material around a work site 100. A pile building operation includes pushing materials into a pile additively, with new material being added to a leading edge of the pile. Pile building often results in long piles of material, similar to the shape of a loaf of bread. These long piles may be positioned in rows within a work site for efficient piling of work site materials.

Backstacking of materials similarly results in piles of materials. However, in backstacking, new material is added to the back end or trailing edge of the pile. In a backstacking operation, the operator of the machine 110 will form a sloped pile and will push additive material up the sloped pile toward the trailing edge of the pile. As the material is added, the pile grows in both length and in the height of the trailing edge. Thus, backstacking can result in piles that are more efficient than pile building operations.

Pile building and backstacking are challenging operations. An operator must be able to accurately estimate the total volume and mass of work site material to be moved into the piles and must begin forming the pile at a suitable position such that all the material can be accommodated in the pile. In both pile building and backstacking operations, it is important to correctly determine the correct location at which to stop pushing the material, in order to prevent the pile from tipping over. Skilled operators will gain an intuitive sense of how steep and tall a material pile can be before tipping will occur based on the pitch and action of the machine, and so the operator will be able to maximize the amount of material allocated to the material pile.

Inexperienced operators of machines may struggle with understanding when to engage and when to disengage with the material, requiring many passes of the machine to correctly form the pile, thus greatly reducing the overall efficiency of the material moving operations in terms of operator time, machine time, work site usage time, machine wear, and fuel usage. Remote operators of machines also struggle with efficient piling building and backstacking due to the lack of direct feedback normally provided to an operator of the machine when physically present, such as being able to visually observe the state of the machine and material, the sound of the machine operation, the pitch and position of the machine, and other tactile feedback provided through direct physical contact with the machine.

To assist machine operators with material moving operations such as, though not limited to, pile building and backstacking, herein disclosed is a method and system of providing an indicator of a target position to a machine operator. The method may be carried out using the machine and control systems described herein, or may be carried out on any suitable equipment. The method and system can assist operators of machines with efficient operation and piling of materials.

Method of Providing Assistance to Operators

Figure 7:
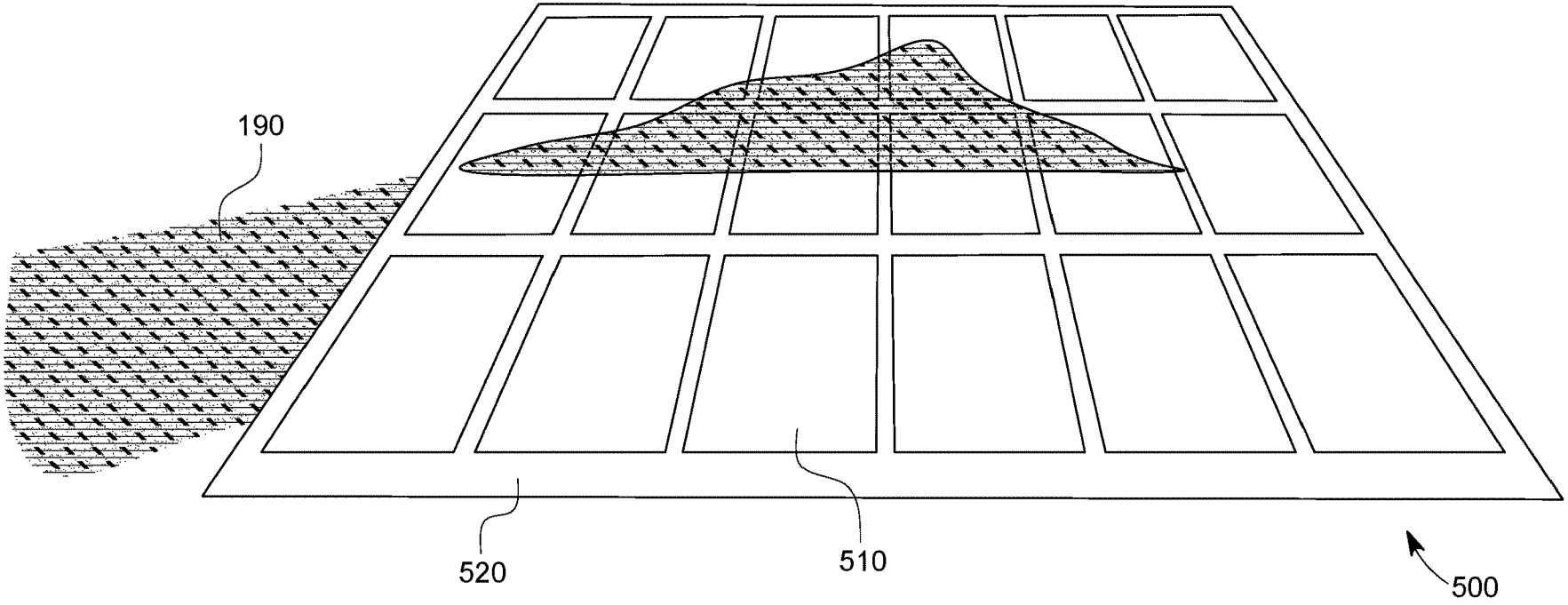
FIG. 7 is an illustration of a visual indication to be provided to a user, according to an embodiment.

According to an aspect, provided herein is a method which provides an indicator to an operator of the machine of a target position. FIG. 7 provides a flowchart of one method of providing an indicator to an operator, per an embodiment. The method 600 includes a receiving step 610 including receiving measurements indicative of one or more geometric characteristics of the work site material, work site material being inclusive of material in a material pile or otherwise present at a work site. Thus, the measurements may include measurements of material to be moved and/or of material already positioned in a material pile and may also include general measurements of the work site. The measurements may be sufficient to permit a control system to generate a two- or three-dimensional map of the work site or of a material pile. In some embodiments, the measurements are sufficient for a control system to generate a 3d topographical map of an area of interest, whether the work site or limited to a material pile and surrounding terrain. The material may be sand, dirt, sod, soil, gravel, rocks, stone, or any other material that must be moved at a work site or a combination of any two or more thereof. The measurements may be provided by an operator based on a visual analysis of the work site and work site material via an input provided to a control system. In some embodiments, the measurements are provided by one or more sensors. The sensors may be attached to the machine itself, or may be otherwise positioned at the work site. In other words, the sensors may be positioned on the machine or may be part of a sensor network remote from the machine, or a combination of both. The sensors may include cameras, stereocameras, SONAR, LIDAR, radar devices, and 4D radar, as non-limiting examples. Combinations of sensors may also be used. In some embodiments, the one or more sensors scans the work site material periodically, such as once a minute, once every 15 seconds, or once a second.

In another step 620, the geometric characteristics of the work site material is compared to target geometric characteristics and a difference is between the two is determined. For example, the target geometric characteristics may provide for a certain portion of the work site material to be moved into piles, through pile building operations, backstacking operations, or other material moving operations. The target geometric characteristics may include projected work site geometry. For example, the target geometric characteristics may include a projected grade and elevation for an area that is a portion of the work site, necessitating movement of material occupying that area. The target geometric characteristics may also include projected material piles based on the volume and density of the material to be moved. Density and volume properties of the material may be provided by an operator or may be available in a database that may be queried. In some embodiments, the target geometric characteristics of the material pile are based on pile building operations. In some embodiments, the target geometric characteristics of the material pile are based on backstacking operations. In some embodiments, the difference is the difference between the target geometric characteristics of a material pile and the actual geometric characteristics of the pile. In some embodiments, the difference is the difference between the target geometric characteristics of all the projected material piles for a work site and the actual geometric characteristics of the material piles, including material piles that may not yet exist. In some embodiments, the difference is the difference between the target geometric characteristics of the work site and the actual geometric characteristics of the work site.

The difference as determined in the method is the difference between the target and actual geometric characteristics of at least a portion of the work site. In some embodiments, the difference may be the difference between the target and actual geometric characteristics of the entire work site. In some embodiments, the difference may be the difference between the target and actual geometric characteristics of a material pile. In some embodiments, the difference may be the difference between the height of portions of a surface of the material pile that are higher or lower than the target height for the surface. In some embodiments, the difference may be the difference between the slope of portions of a surface of the material pile that are more or less sloped (steeper or more shallow) than the target slope for the surface. In some embodiments, the difference may be the difference between a position of the leading or trailing edge of the material pile and the target position for the leading or the trailing edge of the material pile. In some embodiments, the difference may be the difference between the length or volume of the material pile and the target length or volume of the material pile. In some embodiments, the difference is a combination of two or more of the foregoing considerations. The difference as determined by the present method provides a quantitative of numerical indication of the difference between the actual geometry and the target geometry.

The difference may be determine for a volume, for an area, for a linear portion, or a point of the work site or material piles, or as a combination of any two or more of these. Two or more portions of the work site and/or material piles may be considered simultaneously. When multiple portions of the work site and/or material piles are considered, they may be weighted equally or weighted based on the encompassed volume/area/length/point size, or by any other factor. The difference may be determined numerically or on an additive absolute basis (e.g., 15 ft of difference) or as a percentage of the target characteristic (e.g., 20% difference).

A target position is determined in another step 630. The target position is determined according to a material movement operation of the machine, such as, but not limited to, a pile building or backstacking operation. The target position is based on the difference between the target geometric characteristics and the actual geometric characteristics. The target position corresponds to a single material movement operation and is updated for each subsequent material movement operation. Often several operations will be required to create the target geometric characteristics. As such, a plurality of material movement operations are calculated to collectively result in one or more of the target geometric characteristics. In another step 640, an indication of the target position is provided to the operator of the machine.

The various embodiments of the target position and associated indicator should be understood to broadly encompass an assist to an operator for a wide variety of material moving operations. The target position may be any position determined to assist the operator with obtaining the desired target geometric characteristics. In some embodiments, the target position is an initial contact position for a tool associated with the machine, such as a point where the operator should engage the material with the blade of the machine. Such a target point could assist an operator with forming a desired grade, as a non-limiting example. In some embodiments, the target position is an end contact position for the tool, such as a point at which the operator should disengage with contacting the material. Such a target position may be useful to assist an operator with avoiding tipping a pile over during a backstacking operation, as a non-limiting example. In some embodiments, the target position is a position for the machine associated with the beginning of a current material movement operation, such that it will indicate to the operator where to position the machine for the operation. In some embodiments, the target position is a position of the machine associated with the end of the current material movement operation, such that it indicates to the operator when to stop an operation. In some embodiments, the target position is a position for the machine associated with the beginning or the end of a previous material movement operation, such that it indicates to an operator the position of the machine when they began or ended the previous operation so that the operator may adjust accordingly. In some embodiments, the target position is a target leading or trailing edge of the material pile, such that the operator may ascertain where a material pile should begin or end.

The indication may be provided to the operator by a visual indication, a audible indication, a haptic indication, or a combination thereof. As non-limiting examples, the indication may be one of more of a light, a series of lights, a multi-color light, a periodic or persistent alarm, a tone, a display, and a display overlay. The indicator may be provided by haptic feedback to the operator. As a non-limiting example, the controls for the operator may vibrate or pulse as an indicator of a position or of the machine's proximity to the target position. Other potential forms of haptic feedback include vibrations or pulses provided via wearable devices, such as headsets, vests, wrist wraps, or gloves, or provided by pedal or even the operator's seat.

Figure 4:
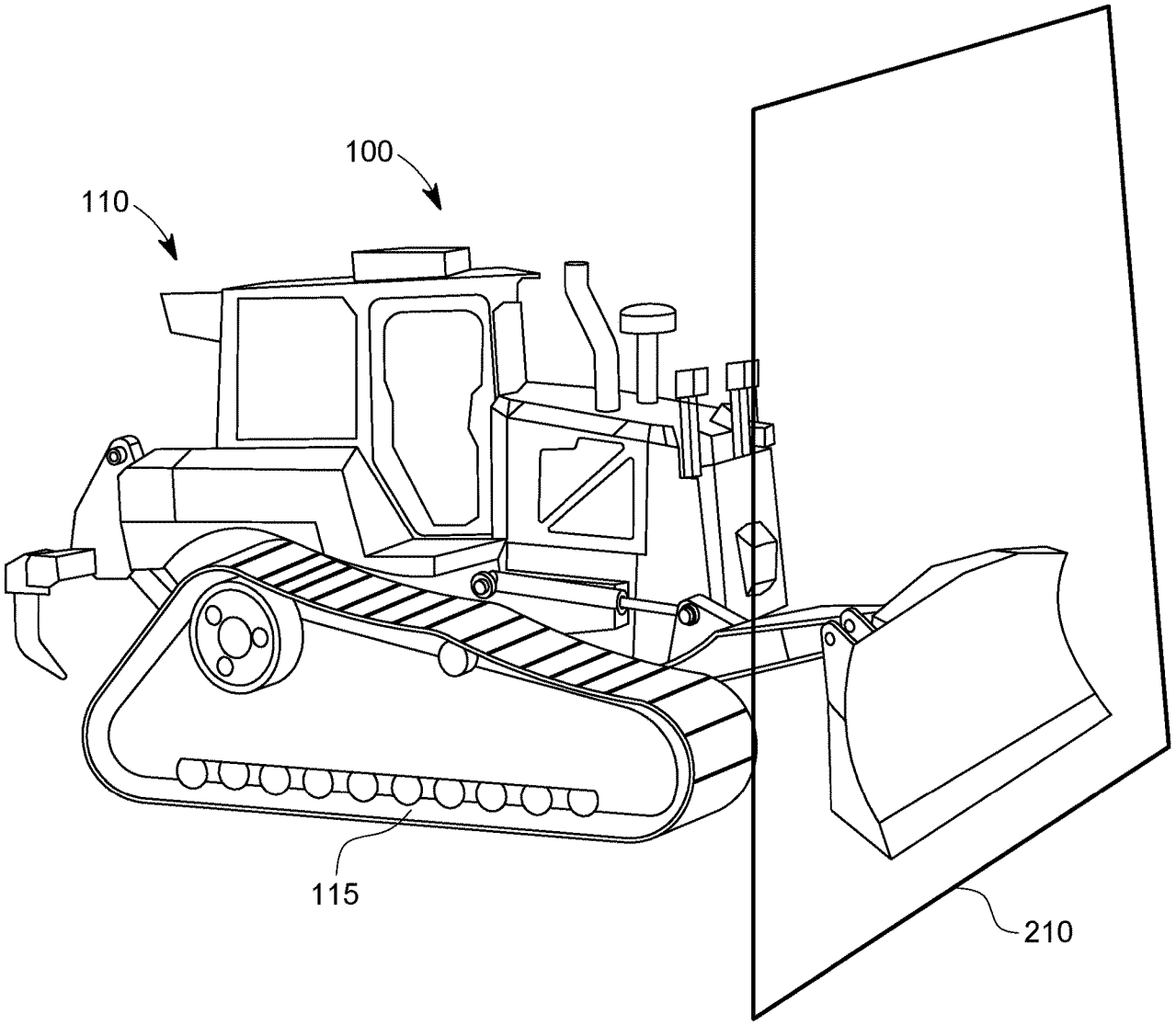
FIG. 4 is an illustration of a machine and a visual indication of a target position, according to an embodiment.

In embodiments in which the indicator is provided at least partially in a visual form, the indicator may be a provided via a display observable by the user. The display may be in the cab of the machine (FIG. 1, 124). Alternatively, when the user is remotely operating the machine, the displays may be a portion of the user interface provided to the operator (FIG. 3, 254). FIGS. 4-7 show various embodiments of the visual indication. The visual indication may be one or more of a plane, a point, a line, a numerical display, or a text display. As shown in FIG. 4, the visual indication 210 may overlay a visual representation of the work site 200. The visual indication 210 may be a plane or other visual feature indicating the target point as previously described. The visual indication 210 may be displayed in a first-person perspective (see FIG. 7) or in a third-person perspective, as shown in FIG. 4, thereby displaying the visual indicator in relation to the machine 110.

Figure 5:
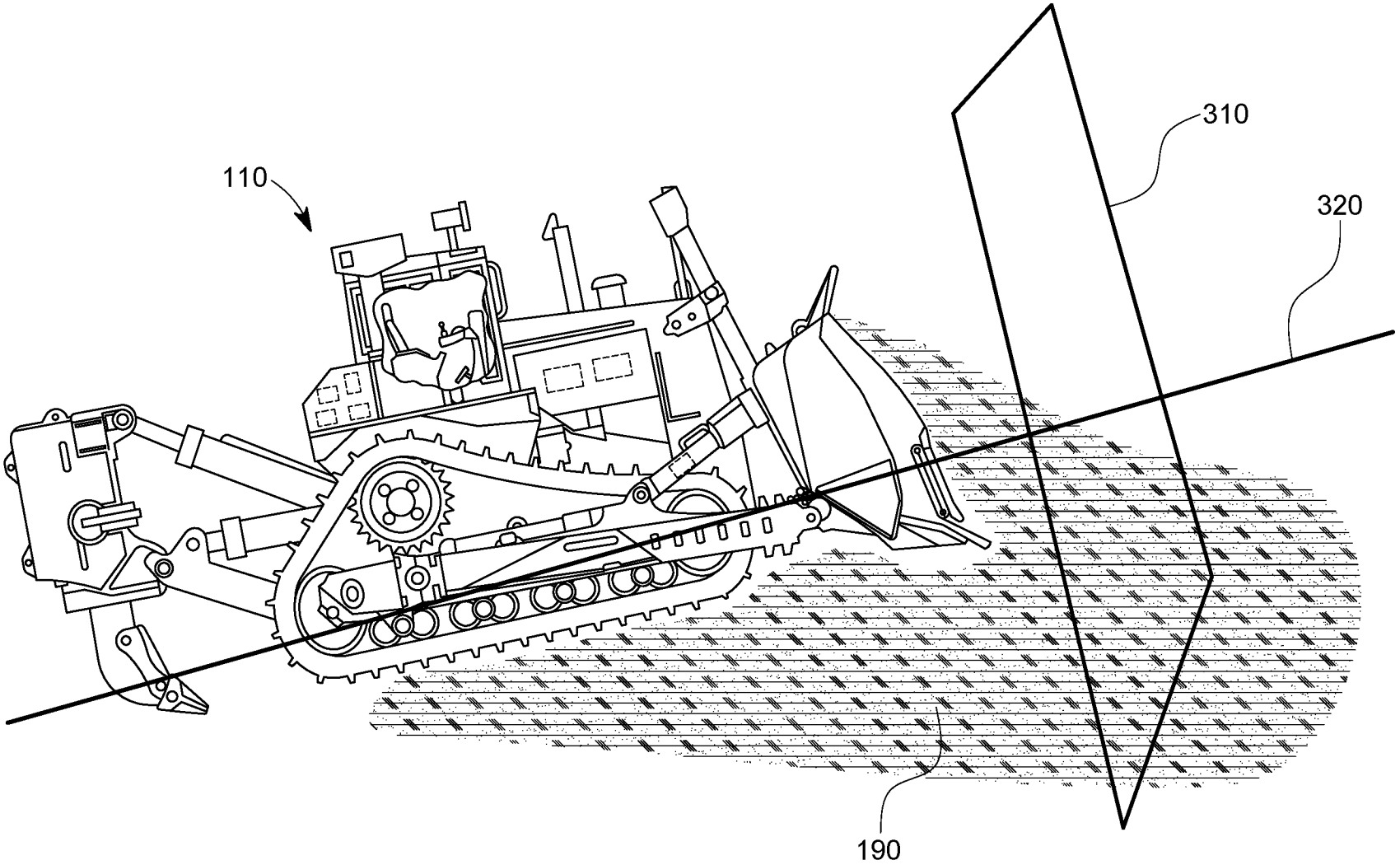
FIG. 5 is an illustration of a machine and a visual indication of a target position, according to an embodiment.

The visual indication may include a slope feature, such as a line or plane 320, as shown in FIG. 5. The slope feature 320 may indicate a current or target slope of the material pile, the current or target slope of the machine, or the current or target slope of the tool, as non-limiting examples. The slope feature 320 may be combined with a second visual indicator 310. The second visual indicator 310 may be one or more of a plane, a point, a line, a numerical display, or a text display. The second visual indicator 310 may be used to provide additional information to an operator, such as a start/stop position for the machine, a leading/trailing edge location for a pile, or a target slope for a trailing edge of a backstacked pile.

Figure 6:
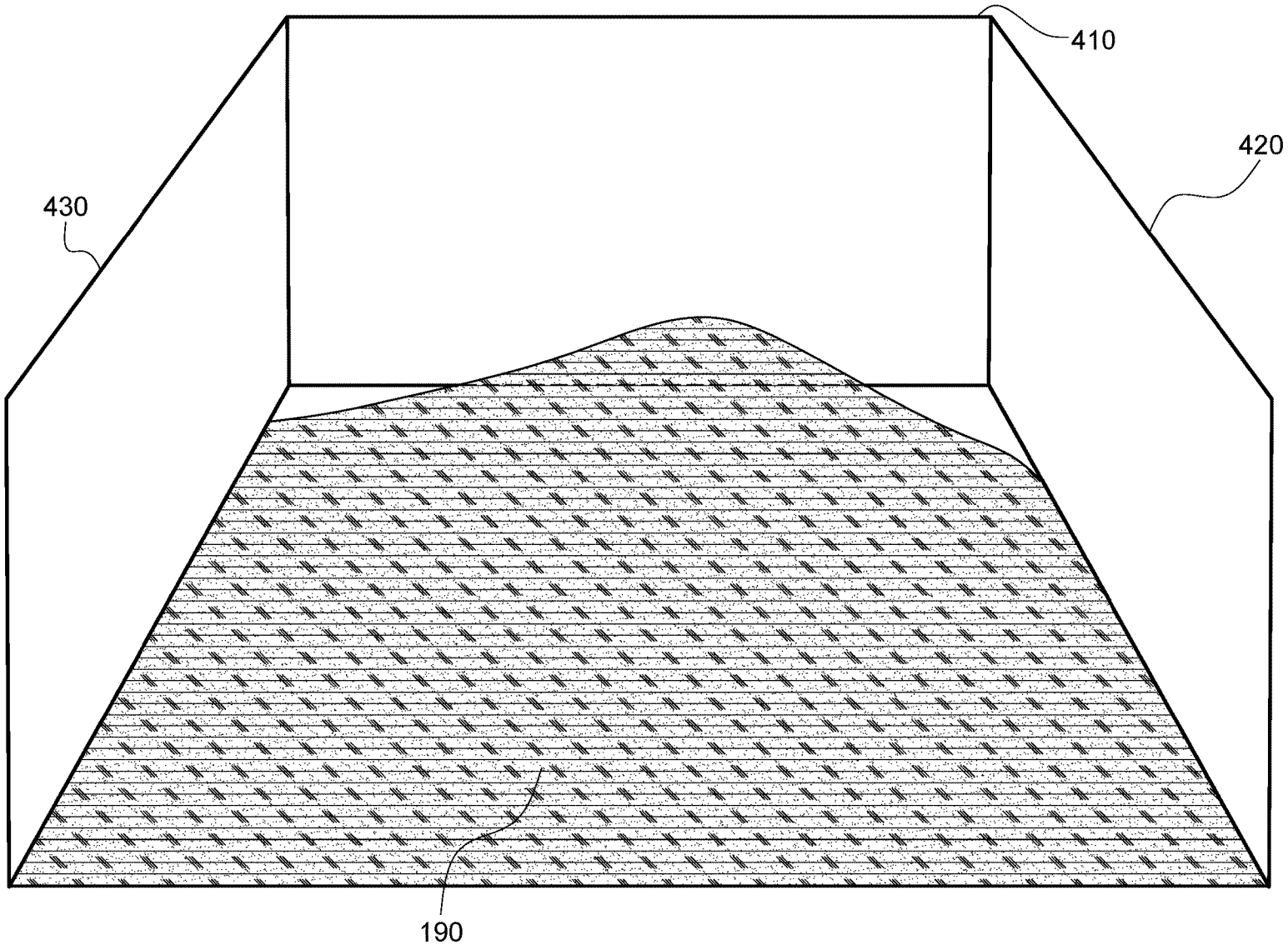
FIG. 6 is an illustration of a visual indication to be provided to a user, according to an embodiment.

The visual indication may also provide operation boundaries for the operator, as illustrated in FIG. 6. Boundary indicators 410 420 430, such as the illustrated planes, may indicate boundaries of safe operation of the machine. Although planes are shown in FIG. 6, it should be understood that any suitable visual indicator may be used as boundary indicators 410 420 430, such as solid or broken or dotted lines, cross hatching, color overlays, points, text, numbers, etc. Such boundary indicators may be used to assist an operator with avoiding entering locations where the machine could cause damage to the work site or high traffic areas where the presence of the machine could hinder smooth operation of the work site, or area where workers are present who could be harmed by the operation of the machine.

In some embodiments, the visual indicator may be used to indicate the difference between the current geometric characteristics and the target geometric characteristics. As exemplified in FIG. 7, the visual indicator may include a plane 500 overlaid at least a portion of the worksite. Other visual indicators are possible, as previously discussed, including solid or broken or dotted lines, cross hatching, color overlays, points, text, numbers, etc. In the embodiments in which a plane is used as the visual indicator, subplanes 510 may be included within the plane boundaries 520, to assist the operator with identifying portions of the worksite or material piles that have geometric characteristics that are farther from the target characteristics. Portions of the plane 500 may be shaded or colored to indicate higher or lower values of the difference between the target and actual geometric characteristics. Contour lines may also be used to the same effect, whether mono- or multi-colored.

System for Providing Assistance to Operators

Various operations described herein can be implemented on computer systems. FIG. 2 shows a diagram of a representative computing control 147 system that may be used to control the machine. Such a control system may also be used to carry out the method of assisting an operator with the efficient operation of a machine, as described herein. A control system may assist an operator in reducing the number of operations required to form piles of material and may assist the operator in maximizing the space efficiency of said piles.

Figure 9:
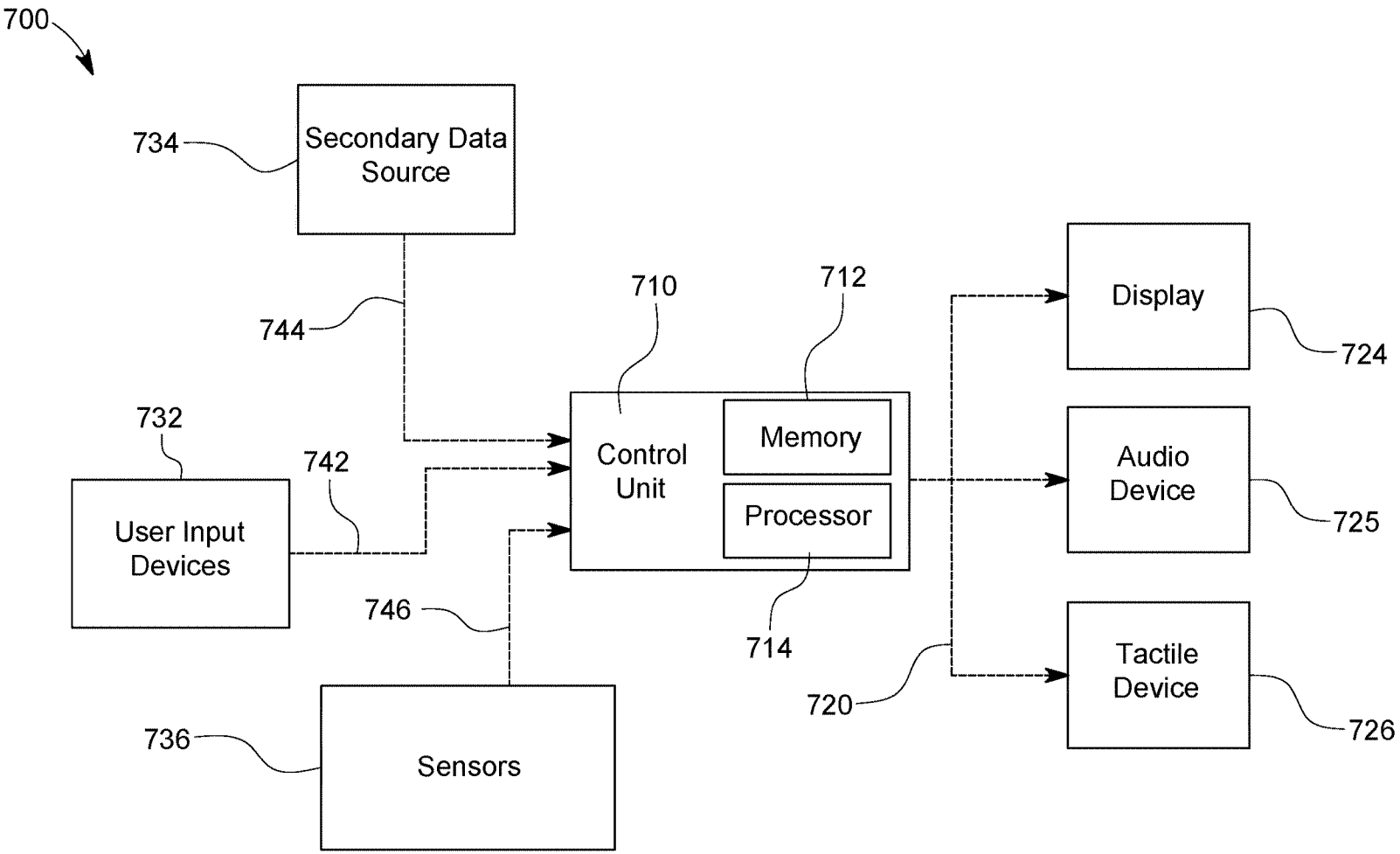
FIG. 9 is a schematic illustration of a control system, according to an embodiment.

In one embodiment, as illustrated in FIG. 9, a control system 700 may include a control unit 710 having one or more processors 714 and a computer memory 712 usable to implement the present disclosure. The computing system can be implemented, for example, as a consumer device such as a smartphone, other mobile phone, tablet computer, wearable computing device (e.g., smart watch, eyeglasses, head wearable display), desktop computer, laptop computer, or implemented with distributed computing devices. In some embodiments, the control unit 710 is the computing system. In other embodiments, the computing system is a portion or subsystem of the control unit 710. In some embodiments, the computing system may include conventional computer components such as one or more processors 714, storage device or computer memory 712, network interface, user input devices 732, and various user output devices 724 725 726.

A network interface coupled to or otherwise in communication with the computer system can provide a connection to a wide area network (e.g., the Internet) to which WAN interface of a remote server system can also be connected. Network interface can include a wired interface (e.g., Ethernet) and/or a wireless interface implementing various RF data communication standards such as Wi-Fi, Bluetooth, UWB, or cellular data network standards (e.g., 3G, 4G, 5G, 60 GHz, LTE, etc.).

User input devices 732 can include any device (or devices) via which a user can provide signals to the computing system; computing system can interpret the signals as indicative of particular user requests or information. The user input device can include any or all of a keyboard, touch pad, touch screen, mouse or other pointing device, scroll wheel, click wheel, dial, button, switch, keypad, microphone, sensors (e.g., a motion sensor, an eye tracking sensor, etc.), pedals, levers, and so on.

In some embodiments, sensors 736 provide measurements or signals 746 to the control unit 710 that provide information about the environment around the machine. The sensors 736 may be located on the machine or may be remote to the machine or may be a combination of sensors on the machine and remote sensors. The sensors may be one or more of a camera, a stereocamera, a SONAR, a LIDAR, a 4D radar, or a combination thereof.

The control system 700 may also include one or more secondary data sources 734 configured to provide data 744 to the control unit 710. The secondary data source 734 may, for example, provide information on the work site, such as the work site boundaries or weather conditions. The secondary data source 734 may provide data on the materials to be moved at the work site, such as the material composition, density, moisture content, etc. The secondary data source 734 may store the data in any usable format, such as a callable variable, a searchable index, a lookup table, etc.

In some embodiments, the control system 700 is configured to execute code that, when executed, determines geometric characteristics for the work site or for material piles based on data 744 746 provided by the sensors 736 and/or secondary data sources 734, and/or user inputs 742 provided by the user via one or more user input devices 732. The control system 700 may be configured to determine actual geometric characteristics and target geometric characteristics of the work site and/or material piles. In some embodiments, the control system 700 is configured to determine actual geometric characteristics of the work site and/or material piles while target geometric characteristics are otherwise provided to the control system. In some embodiments, the control system 700 is configured to determine target geometric characteristics of the work site and/or material piles while the actual geometric characteristics are otherwise provided to the control system.

The control system 700 is further configured to determine, through the execution of code, a difference between the actual and target geometric characteristics. As discussed previously when describing the method, the difference may be absolute or relative. It may be limited to a portion of the geometry of the work site or material pile, such as a particular volume, area, line, or point, or it may consider all of the geometry.

The control system 700 is further configured to determine a target position. The target position may be any position determined to assist the operator with obtaining the desired target geometric characteristics and to do so in an efficient manner. In some embodiments, the target position is an initial contact position for a tool associated with the machine, such as a point where the operator should engage the material with the blade of the machine. Such a target point could assist an operator with forming a desired grade, as a non-limiting example. In some embodiments, the target position is an end contact position for the tool, such as a point at which the operator should disengage with contacting the material. Such a target position may be useful to assist an operator with avoiding tipping a pile over during a backstacking operation, as a non-limiting example. In some embodiments, the target position is a position for the machine associated with the beginning of a current material movement operation, such that it will indicate to the operator where to position the machine for the operation. In some embodiments, the target position is a position of the machine associated with the end of the current material movement operation, such that it indicates to the operator when to stop an operation. In some embodiments, the target position is a position for the machine associated with the beginning or the end of a previous material movement operation, such that it indicates to an operator the position of the machine when they began or ended the previous operation so that the operator may adjust accordingly. In some embodiments, the target position is a target leading or trailing edge of the material pile, such that the operator may ascertain where a material pile should begin or end. In some embodiments, the target position is a boundary for an area in which the machine should not travel, and the indication is provided to assist the operator with avoiding operation of the machine in the indicated area.

The control system 700 may be configured to determine the target position periodically, or in response to an input provided to the system, or in response to the machine completing an operator or arriving at a location. The control system 700 may update determination of the target position when the machine arrives at the target position. The control system 700 may update the target position when a material movement operation, such as, but not limited to, a pile building or backstacking operation, has been completed. The control system 700 may update the target position when a user request, via a user input device 732 for the control system 700 to determine a new target position. The control system 700 may update the target position in response to a change in a parameter or measurement, as provide by the sensors 736 or the secondary data sources 734.

The control system 700 is configured to provide an indication of the target position to an operator of the machine. Various user output devices 724 725 726 can include any device via which the control system can provide information to a user. For example, the user output devices can include an audio device 725 to provide audible signals to a user, such as a speaker or whistle.

The indication may be provided as a tactile signal provided by a tactile device 726. In some embodiments, the tactile device is one or more of the controls for the machine, such as a joystick, lever or pedal. In other embodiments, the tactile device 726 is a vest, wrist strap, headset or other device worn by the operator. In some embodiments, the tactile indication is provided by the seat of the operator. In some embodiments, the tactile device 726 vibrates or pulses to provide the indication of the target position. In some embodiments, the tactile device pulls or pushes on the operator or moves a joystick or other instrument to indicate the target position.

The control system 700 may provide the indication to the operator via a display 724, which may display the target position to the operator. The user output devices can include a display 724 to display images generated by or delivered to the control unit 710. The display can incorporate various image generation technologies, e.g., a liquid crystal display (LCD), light-emitting diode (LED) including organic light-emitting diodes (OLED), projection system, cathode ray tube (CRT), or the like, together with supporting electronics (e.g., digital-to-analog or analog-to-digital converters, signal processors, or the like). A device such as a touchscreen that function as both input and output device can be used. Other output devices 725 726 can be provided in addition to or instead of a display. Examples include indicator lights, speakers, tactile "display" devices, printers, and so on. In some embodiments, the screen is part of a dashboard provided to the operator for operating the machine. In some embodiments, the display is part of a headset worn by an operator. In some embodiments, the display overlays the vision of an operator, displaying the indicator to the operator. For example, in some embodiments, the display is smart glasses that overlay the indication into the scene viewed by the operator through the glasses. In some embodiments, the display shows a numerical or graphical indication of the target position.

In some embodiments, the indication is a combination of audio, visual, and/or tactile feedback provided to the operator. The indication of the target position may be an indication of the exact target position, or it may be an indication of position of the machine in relation to the target position. For example, in some embodiments, the indication is a tone or vibration provided by the audio or tactile devices 725 726 that change in frequency or intensity to assist an operator in determining the distance to the target position.

The indication may also be provided visually to an operator. The indication may be provided as text, a line, an arrow, a vector, an area, a plane, or a volume. The indication may be provided as an overlay of a representation of the work site or of a material pile. The indication may be provided as a volume, plane, line, or point overlaid a representation of the work site or of a material pile to show where a material movement operation should begin or end. The indication may be provided as a volume, plane, line, or point overlaid a representation of the work site or of a material pile to show a boundary for the operation of the machine. The indication may be in the form of contour lines or colors applied to an image of the work site or a material pile. In some embodiments, the image of the work site or the material pile are live images captured by the sensors, such that the indication is adjusted in the display in near real time.

INDUSTRIAL APPLICABILITY

The industrial applicability of the system described herein will be readily appreciated from the forgoing discussion. The foregoing discussion is applicable to machines and systems in which a machines 110 are operated autonomously, semi-autonomously, or manually, either in-person or remotely, at a work site 100 where it is desirable to form materials into efficient piles. Such machines and systems may be used at a mining site, a landfill, a quarry, or any other area in such storage and handling of material is desired.

Figure 8:
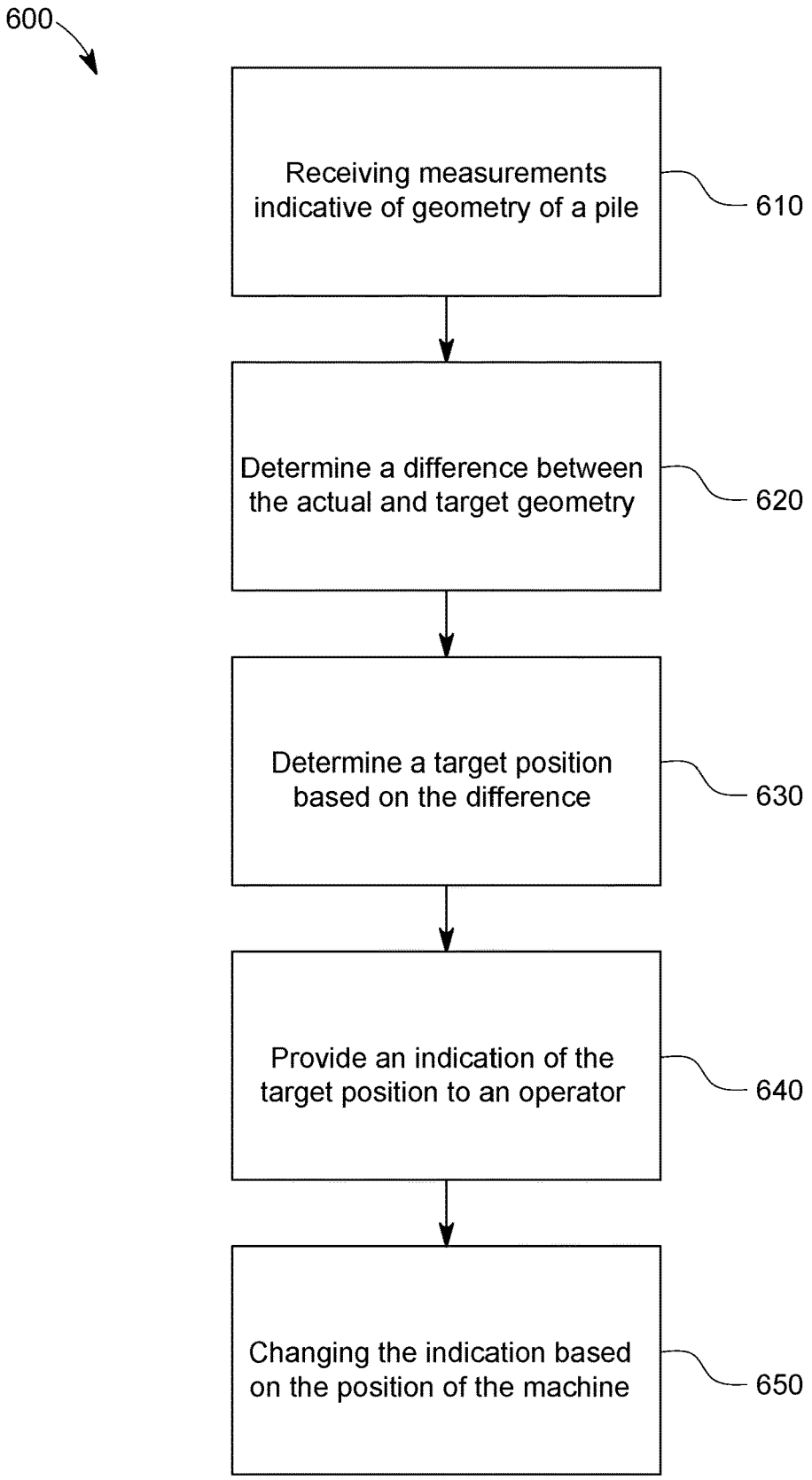
FIG. 8 is flowchart showing a method of providing an indication to an operator of a machine, according to an embodiment.

FIG. 8 depicts a flow chart of an example of providing an indication to an operator of a machine to assist the operator with efficient operation of the machine. By following the methods disclosed herein, an operator can be provided with an indication of a target position. The target position may represent a target position for the machine, a target position for a leading or trailing edge of a material pile, a target slope for a material pile, or an operational boundary for the machine. Per the method disclosed herein, safe and efficient operation of the a machine can be achieved, even by relatively novice or remote operators.

Some implementations include electronic components, such as microprocessors, storage and memory that store computer program instructions in a computer readable storage medium (e.g., non-transitory computer readable medium). Many of the features described in this specification can be implemented as processes that are specified as a set of program instructions encoded on a computer readable storage medium. When these program instructions are executed by one or more processors, they cause the processors to perform various operation indicated in the program instructions. Examples of program instructions or computer code include machine code, such as is produced by a compiler, and files including higher-level code that are executed by a computer, an electronic component, or a microprocessor using an interpreter. Through suitable programming, processor can provide various functionality for the computing system, including any of the functionality described herein as being performed by a server or client, or other functionality associated with message management services.

It will be appreciated that the description of the computing system provided herein is illustrative and that variations and modifications to the configuration or implementation of the computer system are possible. Computer systems used in connection with the present disclosure can have other capabilities not specifically described here. Further, while the computing system is described with reference to particular blocks, it is to be understood that these blocks are defined for convenience of description and are not intended to imply a particular physical arrangement of component parts. For instance, different blocks can be located in the same facility, in the same server rack, on the same motherboard, or on the same circuitry. Further, the blocks need not correspond to physically distinct components. Blocks can be configured to perform various operations, e.g., by programming a processor or providing appropriate control circuitry, and various blocks might or might not be reconfigurable depending on how the initial configuration is obtained. Implementations of the present disclosure can be realized in a variety of apparatus including electronic devices implemented using any combination of circuitry and software.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the figures. It should be noted that the orientation of various elements may differ according to other embodiments, and that such variations are intended to be encompassed by the present disclosure.

The hardware and data processing components used to implement the various processes, operations, illustrative logics, logical blocks, modules, and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the various embodiments is illustrative only. Additionally, any element disclosed in one embodiment may be incorporated or utilized with any other embodiment disclosed herein.

What is claimed is:

1. A method of controlling a machine, the method comprising:

receiving, by one or more processors and from one or more sensors, measurements indicative of one or more geometric characteristics of a material pile;

receiving, by one or more processors, measurements indicative of an amount of material at a work site to be added to the material pile;

determining, by the one or more processors, a difference between the one or more geometric characteristics of the material pile and one or more target geometric characteristics of the material pile, the difference being indicative of material to be moved by the machine;

determining, by the one or more processors, a target position associated with a material movement operation of the machine, wherein the target position is based on the difference, wherein the target position corresponds to a single material movement operation, and wherein the target position is updated for each subsequent material movement operation of a plurality of material movement operations that are calculated to add material at the work site to the material pile and to collectively result in the one or more target geometric characteristics of the material pile;

providing, by the one or more processors, an indication of the target position to an operator of the machine; and causing the machine to carry out one or more of the plurality of material movement operations, wherein the material movement operation comprises a pile building operation or a backstacking operation.

2. The method of claim 1, wherein the target position comprises at least one of an initial contact position for a tool associated with the machine, an end contact position for the tool, a position for the machine associated with the beginning of a current material movement operation, a position of the machine associated with the end of the current material movement operation, a position for the machine associated with the beginning of a previous material movement operation, a position of the machine associated with the end of the previous material movement operation, a target leading edge of the material pile, a target trailing edge of the material pile, a position of the machine, or a slope of the machine.

3. The method of claim 1, wherein determining the difference is based on one or more of:

portions of a surface of the material pile that are lower than a target surface of the material pile, portions of the surface of the material pile that are higher than the target surface of the material pile, a slope of the material pile, a leading edge of the material pile, a trailing edge of the material pile, a height of the material pile, a length of the material pile, or a volume of the material pile.

4. The method of claim 1, wherein the indication provided to the operator of the machine is a visual indication, an audible indication, a haptic indication, or a combination thereof.

5. The method of claim 4, wherein a frequency of the audible indication or a frequency of the haptic indication changes based on a position of the machine with respect to the target position, the one or more geometric characteristics of the material pile, or the one or more target geometric characteristics of the material pile.

6. The method of claim 1, wherein providing the indication to the operator of the machine comprises: displaying, via a display unit, to the operator a visual indicator of the target position.

7. The method of claim 6, wherein the visual indicator comprises a plane overlaying a representation of at least a portion of the material pile.

8. The method of claim 6, further comprising changing one or more visual features of the visual indicator based on a position of the machine, the one or more geometric characteristics of the material pile, or the one or more target geometric characteristics of the material pile.

9. The method of claim 6, wherein the visual indicator further indicates information of at least one of the one or more target geometric characteristics of the material pile or the difference.

10. The method of claim 6, wherein the visual indicator comprises one or more planes indicating boundaries of the target position.

11. The method of claim 10, wherein the one or more planes indicating boundaries include an end plane that corresponds to an end point for depositing an amount of material on a current material movement operation.

12. A system comprising:

a control circuit comprising one or more processors and memory structured to store instructions that, when executed by the one or more processors, cause the control circuit to:

receive, by one or more processors and from one or more sensors, measurements indicative of one or more geometric characteristics of a material pile;

receive, by one or more processors, measurements indicative of an amount of material at a work site to be added to the material pile;

determine, by the one or more processors, a difference between the one or more geometric characteristics of the material pile and one or more target geometric characteristics of the material pile, the difference being indicative of material to be moved by the machine;

determine, by the one or more processors, a target position associated with a material movement operation of the machine, wherein the target position is based on the difference, wherein the target position corresponds to a single material movement operation, and wherein the target position is updated for each subsequent material movement operation of a plurality of material movement operations that are calculated to add material at the work site to the material pile and to collectively result in the one or more target geometric characteristics of the material pile;

provide, by the one or more processors, an indication of the target position to an operator of the machine; and updating the target position in response to completion of a material movement operation;

wherein the material movement operation comprises a pile building operation or a backstacking operation.

13. The system of claim 12, wherein the target position comprises at least one of an initial contact position for a tool associated with the machine, an end contact position for the tool, a position for the machine associated with the beginning of a current material movement operation, a position of the machine associated with the end of the current material movement operation, a position for the machine associated with the beginning of a previous material movement operation, a position of the machine associated with the end of the previous material movement operation, a target leading edge of the material pile, a target trailing edge of the material pile, a position of the machine, or a slope of the machine.

14. The system of claim 12, wherein determining the difference is according to one or more of:

portions of a surface of the material pile that are lower than a target surface of the material pile, portions of the surface of the material pile that are higher than the target surface of the material pile, a slope of the material pile, a leading edge of the material pile, a trailing edge of the material pile, a height of the material pile, a length of the material pile, or a volume of the material pile.

15. The system of claim 12, wherein the one or more sensors are a camera, a stereocamera, a LIDAR, a 4D radar, or a combination thereof.

16. The system of claim 12, wherein providing an indication to an operator of the machine comprises: displaying, via a display unit, to the operator a visual indicator of the target position.

17. The system of claim 16, wherein the visual indicator comprises a plane overlaying a representation of at least a portion of the material pile.

18. The system of claim 16, wherein the visual indicator comprises one or more planes indicating boundaries of the target position.

19. The system of claim 18, wherein the one or more planes indicating boundaries include an end plane that corresponds to an end point for depositing an amount of material on a current material movement operation.

20. A machine comprising:

a tool for engaging with a material of a material pile;

a sensor configured to measure one or more geometric characteristics of the material pile;

an output device; and a control circuit comprising one or more processors and memory structured to store instructions that, when executed by the one or more processors, cause the control circuit to:

receive, by one or more processors and from one or more sensors, measurements indicative of one or more geometric characteristics of a material pile;

receive, by one or more processors, measurements indicative of an amount of material at a work site to be added to the material pile;

determine, by the one or more processors, a difference between the one or more geometric characteristics of the material pile and one or more target geometric characteristics of the material pile, the difference being indicative of material to be moved by the machine;

determine, by the one or more processors, a target position associated with a material movement operation of the machine, wherein the target position is based on the difference, wherein the target position corresponds to a single material movement operation, and wherein the target position is updated for each subsequent material movement operation of a plurality of material movement operations that are calculated to add material at the work site to the material pile and to collectively result in the one or more target geometric characteristics of the material pile; and provide, by the one or more processors and the output device, an indication of the target position to an operator of the machine, updating the target position in response to completion of a material movement operation;

wherein the material movement operation comprises a pile building operation or a backstacking operation.

* * * * *